United States Patent [19]

van de Weijer et al.

[11] Patent Number: 4,475,061

[45] Date of Patent: Oct. 2, 1984

[54] HIGH-PRESSURE DISCHARGE LAMP CURRENT SUPPLY MEMBER AND MOUNTING SEAL CONSTRUCTION

[75] Inventors: Martinus H. A. van de Weijer, Eindhoven, Netherlands; John Fitzgerald, Hamilton, Great Britain; Cornelis A. J. Jacobs, Eindhoven, Netherlands

[73] Assignee: U.S. Philips Corporation, New York, N.Y.

[21] Appl. No.: 296,654

[22] Filed: Aug. 27, 1981

[30] Foreign Application Priority Data

Sep. 5, 1980 [NL] Netherlands ..... 8005026

[51] Int. Cl.[3] ..... H01J 17/16

[52] U.S. Cl. ..... 313/623; 313/625

[58] Field of Search ..... 313/634, 571, 573, 574, 313/620, 636, 623, 625, 624

[56] References Cited

U.S. PATENT DOCUMENTS

| | | | |
|---|---|---|---|
| 3,234,421 | 2/1966 | Reiling | 313/27 X |
| 3,498,714 | 3/1970 | Elmer | 313/634 X |
| 4,065,691 | 12/1977 | McVey | 313/623 X |
| 4,156,826 | 5/1979 | Hernqvist | 313/636 X |
| 4,161,672 | 7/1979 | Cap et al. | 313/634 X |
| 4,283,652 | 8/1981 | Van Herck et al. | 313/625 |

*Primary Examiner*—David K. Moore
*Assistant Examiner*—K. Wieder
*Attorney, Agent, or Firm*—Robert S. Smith

[57] ABSTRACT

A high-pressure discharge lamp having a ceramic discharge vessel comprising an ionizable filling which in the operating condition of the lamp comprises a component present in excess, and in which two electrodes are present. The electrode is connected to a pin-shaped current supply member which is surrounded with a small annular gap by an end portion of the discharge vessel. The pin-shaped current supply member and the end portion are connected in a gas-tight manner by means of a glass seal, in which the sealing glass seal extends into the small annular gap in the direction towards the electrode over such a distance that, in the operating condition of the lamp, the temperature at the surface of the glass seal facing the discharge is at least 50 degrees K. lower than the temperature of that part of the filling which determines the vapor pressure of the component present in excess.

5 Claims, 4 Drawing Figures

HIGH-PRESSURE DISCHARGE LAMP CURRENT SUPPLY MEMBER AND MOUNTING SEAL CONSTRUCTION

The invention relates to a high-pressure discharge lamp having a ceramic discharge vessel, comprising an ionizable filling which in the operating condition of the lamp comprises a component which is present in excess, and in which two electrodes are present between which during operation of the lamp the discharge takes place, one electrode being connected to a pin-shaped current supply member. The pin-shaped current supply member has an axial member which is surrounded by an end portion of the discharge vessel with a small annular gap intermediate. The end portion and the pin-shaped current supply member are connected in a gas-tight manner by means of a glass seal. The end portion, at least partly has an outside diameter which is smaller than the largest outside diameter of the discharge vessel.

Such a lamp is known from Netherlands Patent Application No. 7612120. An advantage of the known lamp is that, due to the construction of the end portion, the power dissipated in the end portion during operation of the lamp is comparatively small, which is favorable for the temperature control of the discharge vessel. In this known lamp the glass seal extends over the whole length over which the current supply member is surrounded by the end portion with a small gap. It has been found that such a construction can give rise to attack of the seal glass by components of the filling of the discharge vessel. As a result, said components of the filling are at least partly withdrawn from the discharge so that the lamp properties are adversely influenced and the life of the lamp is limited.

It is the object of the invention to provide a means to prevent or at least mitigate the possible attack of the glass seal by components of the filling of the discharge vessel.

A lamp of the kind mentioned in the opening paragraph is characterized according to the invention in that the glass seal extends into the small annular gap only over such a distance in the direction towards the electrode that, in the operating condition of the lamp, the temperature of the surface of the glass seal facing the discharge is at least 50 degrees K. lower than the temperature of that part of the filling which determines the vapor pressure of the component present in excess.

In a lamp according to the invention the surface of the glass seal facing the discharge during operation of the lamp has a temperature which is lower than the highest temperature of the non-evaporated part of the component present in excess. It has surprisingly been found that in general even a temperature difference as low as 50 degrees K. provides a suitable extension of the life of the lamp. The great influence of such a comparatively small temperature difference can be explained by the fact that the reactivity between the filling of the discharge vessel and the sealing glass seal generally increases exponentially with increasing temperature.

A ceramic wall is to be understood to mean herein a wall consisting of monocrystalline material (for example sapphire) or polycrystalline material (for example densely sintered aluminium oxide). The expression "pin-shaped member" as used herein means a thin rod having a diameter between 200 μm and 1.5 mm. The smaller value is determined by the practical workability of the rod and the larger value is determined by thermal stresses occurring in practice between the pin and the end portion of the discharge vessel.

The expression "small annular gap" as used herein means an annular gap with a mean value of at most 0.075 mm and at least 0.01 mm. So the actual value of the gap at some place around the pin-shaped member can be at maximum 0.15 mm. The upper value of the gap is determined by the possibility to get a gas-tight sealing with the glass seal. The lower value of the gap is determined by practical requirements to get the pin-shaped member into the surrounding end portion.

A high-pressure discharge lamp having a sealing member which is surrounded by the discharge vessel with a small gap and is connected to the discharge vessel at one end of the discharge vessel by means of a gas-tight seal is known from UK Pat. No. 1107764. In this known lamp the sealing member, however, is a metal sleeve having an outside diameter which is substantially equal to the inside diameter of the discharge vessel. It has been found that this construction, as a result of comparatively large surface areas of the sealing member and discharge vessel end, results in comparatively large power losses. It may be derived that in a lamp according to the known patent application the comparatively large power losses as a result of said surface areas impede the reaching of a high temperature of the part of the filling present in excess.

The highest temperature of the non-evaporated part of the component of the filling of the discharge vessel present in excess determines the vapour pressure of said component. This highest temperature is sometimes termed vapour-pressure determining temperature. Of course a higher vapour-pressure-determining temperature leads to a higher vapour pressure. Notably lamps having good properties with respect to colour temperature and colour point of the emitted radiation often require a comparatively high vapour pressure and consequently a high vapour-pressure determining temperature. An advantage of a lamp according to the invention is that such a high vapour-pressure-determining temperature can be realized without running the risk of attacking the sealing glass.

In an advantageous embodiment of a lamp in accordance with the invention the small gap, taken from the electrode, is free from the glass seal over at least 3 mm. Such an embodiment has the advantage that the glass seal is present at such a comparatively large distance from the discharge that the temperature of the discharge-facing surface of the glass seal is at least 100 degrees K. lower than the vapor-pressure-determining temperature, so that a considerable extension of the life of the lamp can be achieved in a reproducible manner.

In the case of a preferred embodiment of a lamp in accordance with the invention having a substantially circular-cylindrical discharge vessel, which lamp during operation has a consumed power of at most 100 W, the length over which the current supply member is surrounded by the end portion with a small gap is at least twice the inside diameter of the discharge vessel. It has been found that in this manner, even in the case of lamps having comparatively small dimensions of the discharge vessel, both a sufficiently low value of the temperature of the discharge-facing surface of a sealing glass seal and a good gas-tight seal by means of the sealing glass seal can be obtained.

The discharge vessel of a lamp in accordance with the invention may consist, for example, of a tube which at one end tapers into an end portion having a diameter which is smaller than that of the tube, which end portion surrounds the current supply member with the small gap. The end portion of the discharge vessel of a lamp in accordance with the invention may advantageously be a gas-tight sintered projecting plug. Such a construction can be made comparatively easily.

The filling of the discharge vessel may comprise as components, for example, sodium, mercury, and a rare gas, or mercury, one or more halides, and a rare gas.

The invention is especially of interest for incorporating in lamps of very low wattage, i.e. less than 100 W.

Embodiments of lamps in accordance with the invention will now be described in greater detail with reference to the accompanying drawing. In the drawing.

Figure 1:
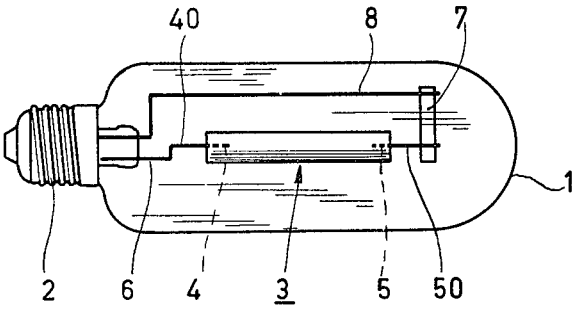
FIG. 1 shows diagrammatically a lamp according to the invention.

The lamp shown in FIG. 1 has an outer envelope 1 provided with a lamp cap 2. In the space enclosed by the outer envelope 1 a discharge vessel 3 is present which has two electrodes 4, 5. Electrode 4 is connected via a pin-shaped current supply member 40 to one end of a rigid current supply conductor 6 the other end of which is connected to a first connection contact of the lamp cap 2. Electrode 5 is connected via a pin-shaped current supply member 50 and a metal strip 7 to a rigid supply conductor 8. Supply conductor 8 is connected to a second connection contact of the lamp cap 2.

Figure 2:
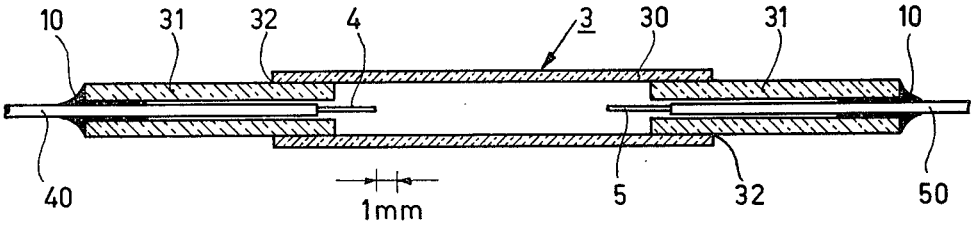
FIG. 2 is a sectional view of the discharge vessel of the lamp shown in FIG. 1.

FIG. 2 is a sectional view of a discharge vessel 3. The discharge vessel is constructed from a tubular part 30 having a circular-cylindrical shape. The part 30 is provided at each end with a respective gas-tight sintered end portion which is constructed as a projecting plug 31. The sintered joints are denoted by 32. Each plug 31 surrounds a respective pin-shaped current supply member 40, 50, with a small gap. The electrode 4 is connected to the pin-shaped current supply member 40 and electrode 5 is connected to the pin-shaped current supply member 50. Each of the pin-shaped current supply members 40, 50 is connected to its associated end plug 31 by means of a gas-tight seal 10 of sealing glass which partly extends into the small gap in the direction towards the electrode.

Figure 3:
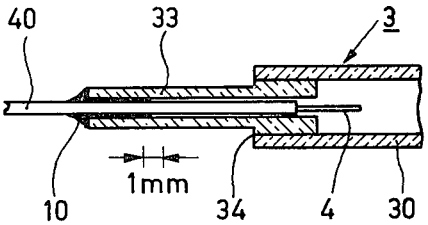
FIG. 3 shows a first modified embodiment of a discharge vessel construction.

In the modified embodiment of the construction of the discharge vessel 3 shown in FIG. 3, the gas-tight sintered end portion constructed as projecting plug 33 has, over the freely projecting part of its length, a smaller diameter than over the longitudinal part connected to portion 30 by means of a sintered joint 34.

Figure 4:
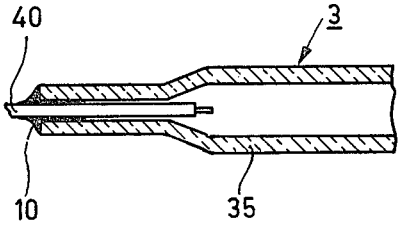
FIG. 4 shows a second modified embodiment of a discharge vessel construction.

A second modified embodiment of the construction of the discharge vessel 3 is shown in FIG. 4. In this case the discharge vessel 3 consists of a single tube 35 which tapers at one end into an end portion which surrounds a current supply member 40 with a small gap. The end portion and the current supply member are sealed in a gas-tight manner by means of a glass seal 10.

In a first example of a lamp having a construction as described with reference to FIG. 1 and 2, the circular-cylindrical portion 30 and the end portions 31 consist of densely sintered aluminium oxide. In this case the circular-cylindrical part has an inside diameter of 2.5 mm and an outside diameter of 3.5 mm. The two plugs 31 each surround the pin-shaped current supply members 40, 50 with a small gap over a length of approximately 11 mm, being approximately 4 times the inside diameter of the discharge vessel, which current supply members have a diameter of 0.7 mm. The pin-shaped current supply members consist of niobium. The use of molybdenum as a material for the current supply members is alternatively possible. The plugs 31 have an outside diameter of approximately 2.5 mm and an inside diameter of approximately 0.8 mm. The electrodes 4,5 each consist of a tungsten pin, 3 mm long, cross-section 0.2 mm. The electrode spacing is 11 mm.

The sealing glass between the plug and the pin-shaped current supply member contains an alkaline earth oxide and extends into the small gap in the direction towards the electrode over a length of approximately 3 mm. This extension of sealing glass into the small gap is realised during lamp fabrication through localised heating of the plug. Taken from the electrode, the small gap is free from the sealing glass seal over a distance of approximately 8 mm.

The filling of the discharge vessel comprises 6 mg amalgam consisting of 27% by weight of Na and 73% by weight of Hg. This amount of amalgam provides an excess of both Na and Hg during lamp operation. In addition to sodium and mercury the discharge vessel comprises xenon which at 300 degrees K. has a pressure of approximately 50 kPa. The lamp is operated at a supply voltage of 220 V, 50 Hz, an inductive stabilization ballast of 1.4H being connected in series with the lamp. The power consumed by the lamp is approximately 30 W and the specific luminous flux is 44 lm/W at a color temperature of 2450 K. The power dissipated by the end portions of said lamp is approximately 8 W. The vapor-pressure-determining temperature is approximately 1210 degrees K., while the temperature at the surface of the sealing glass seal facing the discharge is approximately 1000 degrees K. After 3000 hours in operation it has been found with reference to electrical and light-technical properties of the lamp that the discharge vessel filling has remained substantially constant.

In a second example of a lamp in accordance with the invention in which the construction of the lamp vessel corresponds to the embodiment shown in FIG. 3, the dimensions differ as follows from the above-described lamp; the electrode spacing has been increased to 15 mm, while the plugs over the freely projecting part of their length have an outside diameter of approximately 1.5 mm. Taken from the electrode the small gap is free from the sealing glass seal over a distance of approximately 7 mm. The filling of the discharge vessel is the same as the filling of the discharge vessel of the above-described lamp. The power consumed by the lamp is in this case 25 W and the specific luminous flux is 51 lm/W, the color temperature being approximately 2300 degrees K. The power dissipated by the end portions may be estimated to be approximately 6.6 W. The vapor-pressure-determining temperature in this case is approximately 1190 K. and the surface of the sealing glass seal facing the discharge has a temperature of approximately 1000 degrees K. in these circumstances.

In a third embodiment of a lamp in accordance with the invention in which the construction of the lamp vessel corresponds to the modified embodiment shown in FIG. 3, the dimensions are identical to those of the lamp according to the second embodiment. The filling of the discharge vessel, however, differs in this case in that at 300 K. the xenon pressure is approximately 130 kPa. This lamp has a specific luminous flux of 54 lm/W at a color temperature of approximately 2120 K. and color point coordinates x=0.517; y=0.418. After 4000 hours in operation these quantities have the following values:

specific luminous flux approximately 54 lm/W
color temperature approximately 2080 K.
color point coordinates x=0.523; y=0.421.

This indicates that the filling of the discharge vessel has remained substantially constant during the 4000 hours in operation.

In a lamp not according to the invention in which the dimensions of the discharge vessel correspond to those of the lamp according to the second embodiment on the understanding that the end portions have an outside diameter equal to the outside diameter of the tubular portion of the discharge vessel, such a high power is required, to reach a vapor-pressure-determining temperature during operation of the lamp of 1190 degrees K., that the wall of the discharge vessel at the area of the discharge increases in temperature above the value of 1500 degrees K. permissible for densely sintered aluminium oxide. The power dissipated in the end portions will be approximately 9.2 W.

What is claimed is:

1. A high-pressure discharge lamp having a ceramic discharge vessel, comprising an ionizable filling which in the operating condition of the lamp comprises a component present in excess, and in which two electrodes are present between which during operation of the lamp the discharge takes place, one electrode being connected to a pin-shaped current supply member, said pin-shaped current supply member having an axial portion surrounded by an end portion of the discharge vessel with an intermediate annular gap, said gap having first and second axial portions, said end portions and said pin-shaped current supply member being connected in a gas-tight manner by means of a glass seal, said glass seal extending within said intermediate gap for only said first axial portion thereof, said first axial portion being more remote from said ionizable filling than said second axial portion of said gap, said end portion at least partly having an outside diameter which is smaller than the largest outside diameter of the discharge vessel, characterized in that the glass seal extends into the gap only over such a distance in the direction towards the electrode that, in the operating condition of the lamp, the temperature of the surface of the glass seal facing the discharge is at least 50 degrees K. lower than the temperature of that part of the filling which determines the vapor pressure of the component present in excess.

2. A lamp as claimed in claim 1, characterized in that, measuring from the electrode, the annular gap is free from the glass seal over at least 3 mm.

3. A lamp as claimed in claim 1 or 2 having a substantially circular-cylindrical discharge vessel and a power of at most 100 W during operation of the lamp, characterized in that the length over which the current supply member is surrounded by the end portion with the small gap is at least twice the inside diameter of the discharge vessel.

4. A lamp as claimed in claims 1 or 2, characterized in that the end portion is a gas-tight sintered projecting plug.

5. A lamp as claimed in claim 3, characterized in that the end portion is a gas-tight sintered projecting plug.

* * * * *